US005190489A

United States Patent [19]

Yeung

[11] Patent Number: 5,190,489

[45] Date of Patent: Mar. 2, 1993

[54] INFLATABLE SWIMMING SUPPORTS

[75] Inventor: Tung S. Yeung, North Point, Hong Kong

[73] Assignee: Sunco Products, Inc., Industry, Calif.

[21] Appl. No.: 826,045

[22] Filed: Jan. 27, 1992

[51] Int. Cl.[5] ..... B63C 9/12

[52] U.S. Cl. ..... 441/122; 441/88

[58] Field of Search ..... 441/88, 106–123; 128/89 R

[56] References Cited

U.S. PATENT DOCUMENTS

| | | | |
|---|---|---|---|
| 2,210,809 | 8/1940 | Gray | 441/123 |
| 3,048,860 | 8/1962 | Richardson | 441/123 |
| 3,727,252 | 4/1973 | Bauermeister | 441/122 |
| 3,775,788 | 12/1973 | Markwitz | 441/122 |
| 3,820,179 | 6/1974 | Maertin | 441/122 |

*Primary Examiner*—Joseph F. Peters, Jr.
*Assistant Examiner*—Clifford T. Bartz
*Attorney, Agent, or Firm*—Dominik, Stein, Saccocio, Reese, Colitz & VanDerWall

[57] ABSTRACT

An inflatable swimming support adapted to be worn upon the upper arm of a user, the support comprising a major continuous and closed, torus-shaped air chamber formed of fluid-impervious, flexible material, the major air chamber forming a tubular central arm opening therethrough; a minor continuous and closed, torus-shaped air chamber formed of a strip of fluid-impervious, flexible material, the strip being heat sealed to the material of the major air chamber interiorly along two concentric circular lines and forming a central arm opening therethrough; a first valve means in fluid communication with the major air chamber for the selective inflation and deflation thereof; and a second valve means in fluid communication with the minor air chamber independent of the major air chamber for the selective inflation and deflation of the minor air chamber, the first and second valve means being located in spaced relationship along the length of the central arm opening.

4 Claims, 2 Drawing Sheets

INFLATABLE SWIMMING SUPPORTS

BACKGROUND OF THE INVENTION

1. Field of the Invention

The present invention relates to inflatable swimming supports, and more particularly, to a pneumatic swimming support having a first torus-shaped air chamber designed to fit around the upper arm of a user, and a second torus-shaped air chamber formed integrally with and interiorly of the first torus-shaped air chamber, and with inflation valves coupled to the chambers so as to allow the support to roll up the arm of the wearer.

2. Description of the Background Art

In the field of pneumatic swimming supports it has become common to provide inflatable air chambers sized and shaped to be placed around the upper arm of a wearer, normally a child. The air chambers are conventionally designed in the shape of a doughnut or torus, and they are conventionally fabricated of a thin plastic material which is impervious to both air and water. Such chambers include a standard valve and stem assembly for inflation and deflation purposes.

Pneumatic swimming supports have become widely used to aid children who have not yet developed the capacity to swim. Conventional pneumatic swimming supports, however, have many shortcomings. For example, conventional pneumatic swimming supports are normally constructed of a single air chamber. Such construction is fundamentally dangerous in that if a leak ever develops all buoyancy is lost. A child could drown.

Some pneumatic swimming supports attempt to overcome the single-chamber problem by designs which utilize two separate inflatable chambers coupled together into a common single support. Such designs provide for added emergency buoyancy in the event of a leak in one chamber. Such designs, however, require that the chambers are inflated only after the pneumatic swimming support has been positioned on the wearer's arm. Nowhere in the prior art is there disclosed, taught or suggested a multi-chamber pneumatic swimming support which may be first inflated and then positioned on the wearer by rolling the inflated support up the arm of the wearer.

The background art discloses a number of techniques for improving upon the conventional pneumatic swimming support technology. Consider for example, U.S. Pat. No. 3,727,252 to Bauermeister. According to the Bauermeister disclosure, a swimming support in the form of an inflatable ring is provided with an additional separate buoyant member located within the ring. The separate buoyant member may also be inflatable. Note the embodiment of FIGS. 1 and 2. In such embodiment, the interior air chamber is coupled to the exterior air chamber only through a valve, an ineffective construction. Further, the valves are not spaced along the length of the opening for the wearer's arm. Rolling on the pre-inflated pneumatic swimming support is thus impractical. Lastly, when the first or exterior air chamber is inflated, it is impossible to determine simply by observation whether or not the second or interior air chamber is inflated, a dangerous situation.

In U.S. Pat. No. 3,820,179 to Maertin, there is disclosed a pneumatic swimming support constructed of two tubular air chambers joined along their common circumference. The two air chambers of each pneumatic swimming support function totally independently of each other. Although their two valves are spaced along the length of the opening for the wearer's arm, the rolling on of pre-inflated pneumatic swimming support is impossible.

Lastly, U.S. Pat. No. 3,775,788 to Markwitz, like Maertin, also discloses pneumatic swimming supports with each pneumatic swimming support being constructed of two tubular air chambers joined along a common axial extent. As in Maertin, the two air chambers function totally independent of each other. Their two valves are spaced along the circumference of the opening for the wearer's arm. Because of the construction, the rolling on of pre-inflated pneumatic swimming supports is impossible.

As illustrated in these prior patents as well as in commercial devices, efforts are continuously being made in an attempt to provide an inflatable swimming support which employs a safe, two chamber buoyant construction, yet at the same time lends itself to easy placement upon and removal from the arm of a child. None of these previous efforts, however, provides the benefits attendant with the present invention. Additionally, prior art inflatable swimming supports do not suggest the present inventive combination of component elements arranged and configured as disclosed and claimed herein. The present invention achieves its intended purposes, objectives and advantages over the prior art devices through a new, useful and unobvious combination of component elements, with the use of a minimum number of functioning parts, at a reasonable cost to fabricate, and by employing only readily available materials.

Accordingly, it is an object of the present invention to provide an inflatable swimming support adapted to be worn upon the upper arm of a user, the support comprising a major continuous and closed, torus-shaped air chamber formed of fluid-impervious, flexible material, the major air chamber forming a tubular central arm opening therethrough; a minor continuous and closed, torus-shaped air chamber formed of a strip of fluid-impervious, flexible material, the strip being heat sealed to the material of the major air chamber interiorly along two concentric circular lines and forming a central arm opening therethrough; a first valve extending through the material of the major chamber in fluid communication with the major air chamber for the selective inflation and deflation thereof; and a second valve extending through the material of the major chamber in fluid communication with the minor air chamber independent of the major air chamber for the selective inflation and deflation of the minor air chamber, the first and second valve being located in spaced relationship along the length of the central arm opening.

It is another object of the present invention to employ a pair of cooperable air chambers for pneumatic swimming supports for greater safety.

It is another object of the invention to promote the usage of pneumatic swimming supports which may be inflated off of the wearer and then rolled onto a wearer's arm.

Lastly, it is an object of the present invention to improve pneumatic swimming supports by making them both easier to put on and safer to use.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an inflatable swimming support adapted to be worn upon the limb of a user, the support comprising a major continuous and closed, torus-shaped air chamber formed of fluid-impervious, flexible material, the major air chamber forming a tubular central arm opening therethrough; a minor continuous and closed, torus-shaped air chamber formed of a strip of fluid-impervious, flexible material, the strip being heat sealed to the material of the major air chamber interiorly along two concentric circular lines and forming a central arm opening therethrough; a first valve means in fluid communication with the major air chamber for the selective inflation and deflation thereof; and a second valve means in fluid communication with the minor air chamber independent of the major air chamber for the selective inflation and deflation of the minor air chamber, the first and second valve means being located in spaced relationship along the length of the central arm opening. The major and minor air chambers are coupled to each other along elongated extents. The chambers are formed of polyvinyl chloride and the coupling is effected through heat sealing along two concentric circular lines.

The invention may also be incorporated into an improved inflatable swimming support adapted to be worn upon the upper arm of a user, the support comprising a major continuous and closed, torus-shaped air chamber formed of fluid-impervious, flexible material, the major air chamber forming a tubular central arm opening therethrough; a minor continuous and closed, torus-shaped air chamber formed of a strip of fluid-impervious, flexible material, the strip being heat sealed to the material of the major air chamber interiorly along two concentric circular lines and forming a central arm opening therethrough; a first valve extending through the material of the major chamber in fluid communication with the major air chamber for the selective inflation and deflation thereof; and a second valve extending through the material of the major chamber in fluid communication with the minor air chamber independent of the major air chamber for the selective inflation and deflation of the minor air chamber, the first and second valve being located in spaced relationship along the length of the central arm opening.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to an inflatable swimming support 10. A pair of such supports including their chambers in the inflated condition can readily be seen in FIG. 1 where the supports are operatively positioned on a wearer's limb 16, preferably a wearer's upper arm for operation and use.

Figure 2:
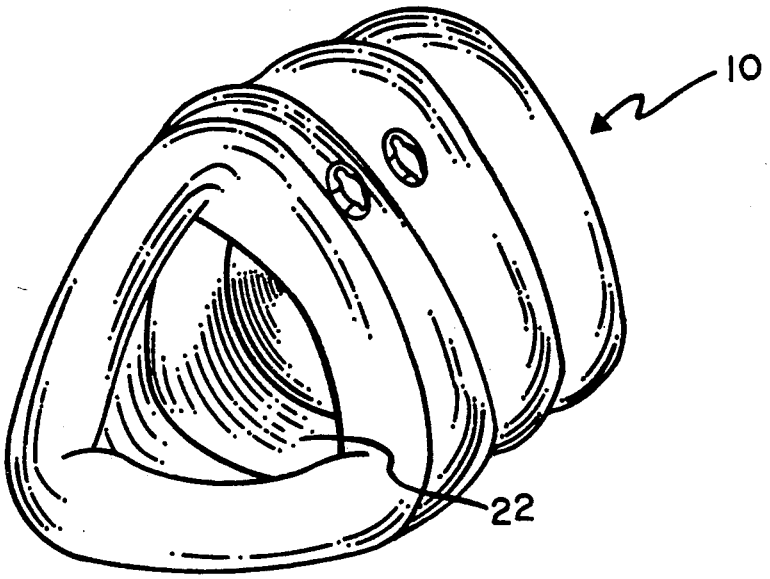
FIG. 2 is an enlarged perspective illustration of one of the inflatable swimming supports shown in FIG. 1 but not located upon the arm of a wearer so as to show greater details thereof.

FIG. 2 is an enlarged perspective illustration of the support 10 off of the wearer's arm but still in inflated condition.

Figure 3:
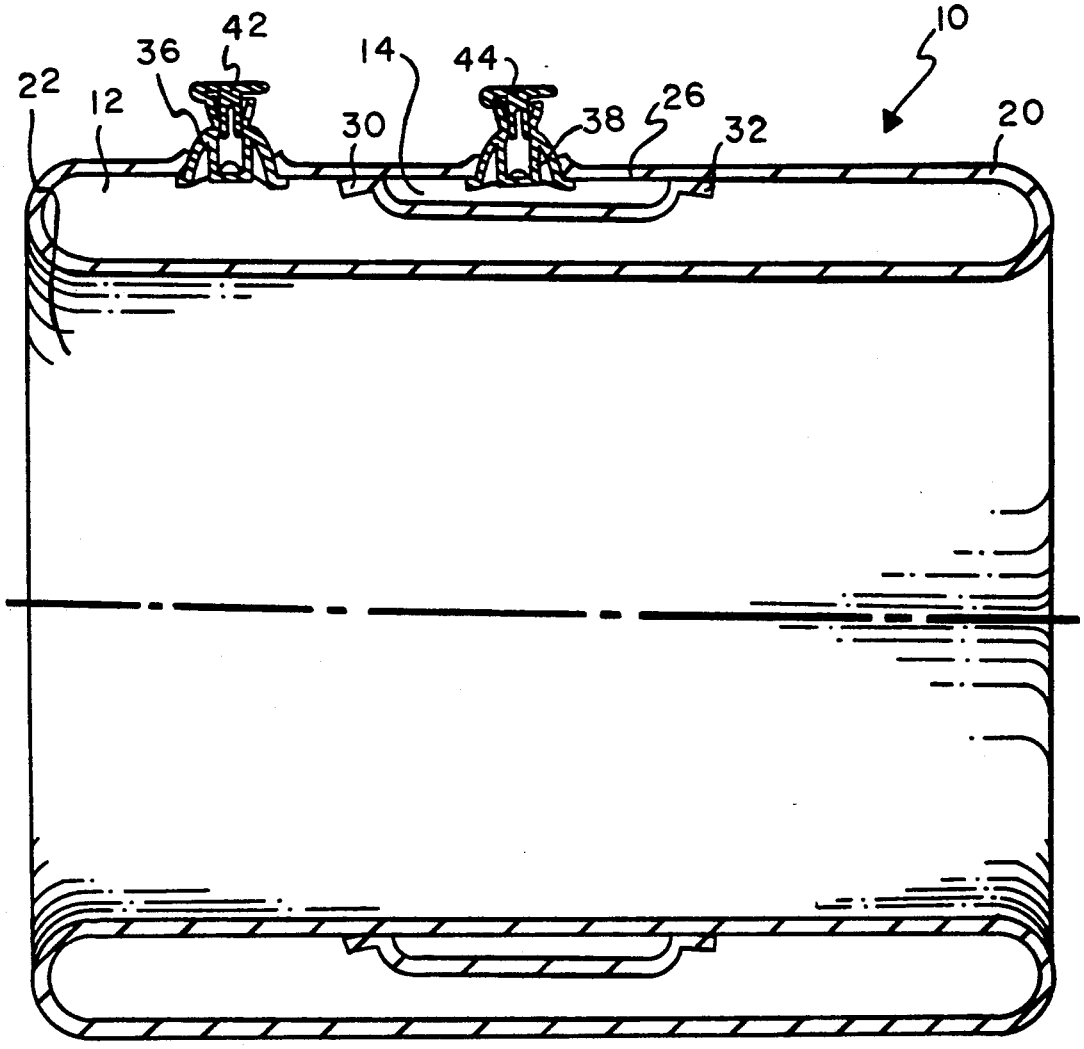
FIG. 3 is a sectional view of one of the inflatable swimming supports in an uninflated condition.

The details of construction of a support are best understood by reference to FIG. 3. FIG. 3 is an enlarged sectional view of the support. Unlike FIGS. 1 and 2, the support 10 is shown in the uninflated condition.

The inflatable swimming support 10 includes a first or major air chamber 12 and a second or minor air chamber 14 correlated to effect the superior results of the present invention. The first or major air chamber 12 is a continuous and closed, torus-shaped air chamber formed of fluid-impervious, flexible material 20. The chamber is formed of an extruded tube, heat sealed circumferentially to form the torus. In the alternative, the chamber is formed of a strip of material heat sealed along its length to form a tube and then heat sealed circumferentially to form a torus. The tube is of a size circumferentially substantially equal to the circumference of the wearer s arm to thereby allow its positioning thereon. The major air chamber forms a tubular central arm opening or axis 22 therethrough for the receipt of the wearer's arm 16 during operation and use.

A second or minor continuous and closed, torus-shaped air chamber 14 is formed of a strip of fluid-impervious, flexible material 24 in cooperation with a portion 26 of the material of the major air chamber. The strip of material 24 is heat sealed along its linear edges 30 and 32 to the interior of the major air chamber 12 along two concentric circular lines of a size substantially equal to the circumference of the wearer's arm to allow its positioning thereon. The minor chamber 14, like the major chamber 12, forms a central arm opening 22 therethrough.

A first valve 36 extends through the material 20 of the major chamber 12 in fluid communication with the major air chamber. This allows for the selective inflation and deflation of the major chamber.

A second valve 38 extends through the material 26 of the major chamber in fluid communication with the minor air chamber 14. This arrangement allows for the independent inflation and deflation of the minor air chamber independent of the inflation and deflation of the major air chamber. The first and second valve means 36 and 38 are located in spaced relationship along the length of the central arm opening, perpendicular to the circumference of the two chambers and the wearer's arm.

Both the major and minor air chambers are made of a thin, resilient, fluid-impervious material. The preferred material is a plastic, more specifically, a soft polyvinyl chloride, commonly called PVC. By fluid-impervious it is meant a material which will not allow the escape of air from the interior of the support or the entrance of water into the interior of the support.

The valves are both conventional in construction and use. Inflation is effected by removing the attached cap 42 and 44 and blowing air into the chambers, either orally or by machine. The cap is repositioned as shown during operation and use. Deflation is effected by removing the cap and squeezing the valve radially.

In addition, each of the swimming supports are preferably colored such that they are easily visible. A bright optic orange is a preferred color.

Figure 1:
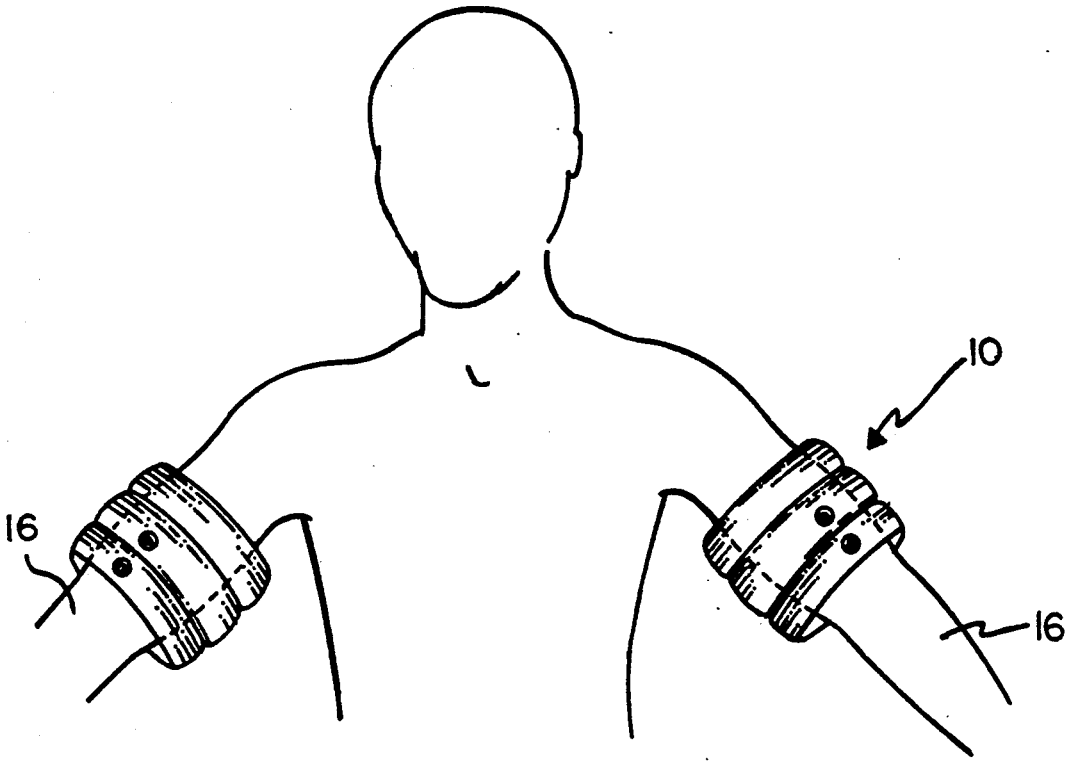
FIG. 1 is a persepctive illustration of a pair of the swimming supports of the present invention, inflated and in operational position upon the upper arms of a child.

In operation and use, the support 10 may be placed upon the upper arm of the wearer and then inflated in the normal fashion. In the alternative, the support 10 in the uninflated condition, and off of the wearer's arm, may be first inflated and then rolled up the wearer's arm to the position as shown in FIG. 1. When rolling the support up the wearer's arm, the valves 36 and 38 effectively rotate up the arm with the rest of the portions of the chambers, preferably to a location with the valves exposed to view as shown in FIGS. 1 and 2. The support, however, functions equally as well with the valves in contact with the wearer's arm and not exposed to view. In order to remove the support after use, the valves may be used to simply effect chamber deflation in the normal manner. In the alternative, the support may be rolled off of the wearer's arm and then deflated. The rolling on and off of the support renders it more convenient, particularly for a parent putting the support on and off of a child. Such a construction of an inflatable swimming support thus promotes usage and, consequently, increases water safety.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. An inflatable swimming support adapted to be worn upon the limb of a user, the support comprising:

a larger, continuous and closed, doughnut-shaped air chamber formed of fluid-impervious, flexible material, the larger air chamber forming a central arm opening therethrough;

a smaller, substantially doughnut-shaped air chamber formed of fluid-impervious, flexible material, the smaller air chamber being circumferentially secured to the larger air chamber around the central arm opening along spaced lines with the smaller chamber located totally between said lines;

a first valve means in direct fluid communication with the larger air chamber for the selective inflation and deflation thereof; and a second valve mean in direct fluid communication with the smaller air chamber independent of the larger air chamber for the selective inflation and deflation of the smaller air chamber, the first and second valve means being located in spaced relationship on the exterior surface of the support and chambers along the length of the central arm opening whereby the support, with both chambers inflated, may be rolled up and down the limb of a user to any extent.

2. The support as set forth in claim 1 wherein the larger and smaller chambers are coupled to each other along elongated extents.

3. The support as set forth in claim 2 wherein the chambers are formed of polyvinyl chloride and the coupling is effected through heat sealing along two concentric substantially circular lines.

4. An inflatable swimming support adapted to be worn upon the upper arm of a user, the support comprising:

a major continuous and closed, torus-shaped air chamber formed of a first strip of fluid-impervious, flexible material, the major air chamber forming a central arm opening therethrough;

a minor, substantially torus-shaped air chamber formed of a second strip of fluid-impervious, flexible material, the second strip being heat sealed to the material of the major air chamber interiorly along two concentric, substantially circular lines around the central arm opening with the minor chamber located totally between said lines;

a first valve extending directly through only the material of the major chamber in fluid communication with the major air chamber for the selective inflation and deflation thereof; and a second valve extending directly through only the material of the major chamber in fluid communication with the minor air chamber independent of the major air chamber for the selective inflation and deflation of the minor air chamber, the first and second valve being located in spaced relationship along the length of the central arm opening whereby the support may be rolled up and down the limb of a user to any extent while both chambers are inflated.

* * * * *